US008662942B2

(12) United States Patent
Li

(10) Patent No.: US 8,662,942 B2
(45) Date of Patent: Mar. 4, 2014

(54) UNIVERSAL SERIAL BUS HEAD AND MANUFACTURING METHOD THEREOF

(75) Inventor: Leiwen Li, Shenzhen (CN)

(73) Assignee: ZTE Corporation, Shenzhen (CN)

( * ) Notice: Subject to any disclaimer, the term of this patent is extended or adjusted under 35 U.S.C. 154(b) by 0 days.

(21) Appl. No.: 13/519,357

(22) PCT Filed: Oct. 26, 2010

(86) PCT No.: PCT/CN2010/078129
§ 371 (c)(1),
(2), (4) Date: Jun. 27, 2012

(87) PCT Pub. No.: WO2011/150624
PCT Pub. Date: Dec. 8, 2011

(65) Prior Publication Data

US 2012/0295497 A1 Nov. 22, 2012

(30) Foreign Application Priority Data

May 31, 2010 (CN) ..... 2010 1 0188393

(51) Int. Cl.
*H01R 9/24* (2006.01)

(52) U.S. Cl.
USPC ..... 439/885; 439/660; 439/606; 29/592.1; 29/825; 264/161; 264/250

(58) Field of Classification Search
USPC ..... 29/592.1, 825, 832, 841; 264/161, 250, 264/252, 254; 439/885, 660, 604, 606
See application file for complete search history.

(56) References Cited

U.S. PATENT DOCUMENTS

| | | | | |
|---|---|---|---|---|
| 6,638,121 | B1 * | 10/2003 | Walker et al. | 439/885 |
| 7,223,127 | B2 | 5/2007 | Ho | |
| 7,959,478 | B2 * | 6/2011 | Chiu et al. | 439/885 |
| 8,246,387 | B2 * | 8/2012 | Fjelstad | 439/638 |
| 2006/0270281 | A1 | 11/2006 | Ho | |
| 2008/0064265 | A1 * | 3/2008 | Sterling et al. | 439/660 |
| 2010/0112867 | A1 | 5/2010 | Berens | |

(Continued)

FOREIGN PATENT DOCUMENTS

| | | | |
|---|---|---|---|
| CN | 201113074 | Y | 9/2008 |
| CN | 201336435 | Y | 10/2009 |
| CN | 201490410 | U | 5/2010 |
| EP | 1986290 | A1 | 10/2008 |

OTHER PUBLICATIONS

International Search Report in international application No. PCT/CN2010/078129, mailed on Mar. 10, 2011.
English Translation of the Written Opinion of the International Search Authority in international application No. PCT/CN2010/078129, mailed on Mar. 10, 2011.

(Continued)

*Primary Examiner* — Gary Paumen
(74) *Attorney, Agent, or Firm* — Oppedahl Patent Law Firm LLC

(57) ABSTRACT

A method for manufacturing a Universal Serial Bus (USB) head comprises: locating metal sheets with both ends being closed into a first mold and performing a first injection molding; removing a sprue portion and a fixing portion at top of the metal sheets from a product subjected to the first injection molding, to obtain a first-injected-product; locating the first-injected-product into a second mold and performing a second injection molding; removing an exposed fixing portion of the metal sheets from a second-injected-product, to obtain the USB head desired. In the USB head, four metal sheets are arranged with a certain spacing, and the metal sheets are closed at both ends.

8 Claims, 3 Drawing Sheets

(56) References Cited

U.S. PATENT DOCUMENTS

| | | | | |
|---|---|---|---|---|
| 2010/0149735 | A1* | 6/2010 | Zadesky et al. | 361/679.01 |
| 2011/0009008 | A1* | 1/2011 | Wang | 439/660 |
| 2011/0278312 | A1* | 11/2011 | Zadesky et al. | 220/660 |

OTHER PUBLICATIONS

Supplementary European Search Report in European application No. 10852419.0, mailed on Aug. 27, 2013.

* cited by examiner

UNIVERSAL SERIAL BUS HEAD AND MANUFACTURING METHOD THEREOF

TECHNICAL FIELD

The disclosure relates to the field of Universal Serial Bus (USB), particularly to a USB head and a manufacturing method thereof.

BACKGROUND

With the development of living standards and progress of network technologies, people may have greater demands on mobile office and instant Internet access; as a wireless terminal device, a wireless Internet card is one of main mediums for present communications. Generally, as a wireless terminal product, the wireless Internet card is matched with the mobile terminal device so as to realize real-time Internet access functions and facilitate the communications among people in the information age, and especially becomes the electronic product necessary to the business people.

As the wireless Internet card is popularized and the competition is intensified, the wireless Internet card is developed from the originally single function to the personalization and fashion, and stronger in the functions and more beautiful in appearance; the wireless Internet card with a half-closed rotating USB head is the one typical representative. In comparison with the traditional design, the wireless Internet card with such the design is thinner, slenderer and more beautiful.

FIG. 1 is a structure diagram of a half-closed USB head; as shown in FIG. 1, four metal sheets arrange with a certain spacing in the USB head are used as four pins, namely 4 PINs, the four metal sheets are used as interfaces connected with an external device. The metal sheets are only 0.15 mm in fixing depth due to self elasticity and relative thin body; the traditional four Pin metal sheets are not connected into a whole and located only by several holes in the tail part and limited to 0.15 mm height, thus the USB head is easy to deform, extrude or degum in the production procedure of a present first injection moulding, and majority ineffective products are produced to fail to satisfy demands of large-batch production.

In addition, the metal sheets are placed for a long time in the injection procedure while one side of each metal sheet is opened and hard to fix; in a injection mould assembly procedure, the mould assembly is to assemble the mould with the great mechanical thrust so as to prevent the high-pressure injection of the melted plastic in the injection procedure and the huge opening force of the mould generated by mould filling; therefore, the metal sheets are easy to stagger to pinch the mould or the injected product has defect in appearance; once the mould is pressed in the product or has defect in the appearance, the mould repairing is relatively difficult; and the injection mould of the USB head is complex so that the metal sheets are relatively difficult in assembly.

At present, the USB head manufacturing technique generally comprises: locating metal sheets with one end being closed into the mould, and directly performing a first injection molding; taking out a product, removing an exposed fixing portion of the metal sheets, and obtaining the USB head desired; when the USB head is produced, each manufacturing produces the products for the first time by the long-time technique adjustment and running-in if the same USB heads are dispersively manufactured in different manufacturers, so as to easily cause the delay of the project progress and the product quality; and output efficiency is extremely low so as to increase product costs.

SUMMARY

In view of this, the main purpose of the disclosure is to provide a USB head and a method for manufacturing a Universal Serial Bus (USB) head, so as to greatly promote the yield of the USB head, reduce manufacturing costs and improve production efficiency.

For the above purpose, the technical scheme is realized in the following manner:

The disclosure provides a method for manufacturing a Universal Serial Bus (USB) head, which comprises:

step A: locating metal sheets with both ends being closed into a first mould and performing a first injection molding;

step B: removing a sprue portion and a fixing portion at top of the metal sheets from a product subjected to the first injection molding, to obtain a first-injected-product;

step C: locating the first-injected-product into a second mould and performing a second injection molding; and step D: removing an exposed fixing portion of the metal sheets from a second-injected-product, to obtain the USB head desired.

In the scheme, during the first injection molding, only portions near to the fixing portions at the top of the metal sheets may be injected. The metal sheets may be elastic metal sheets.

In the scheme, in the steps B and D, the removing the fixing portions of the metal sheets may comprise: removing the fixing portions of the metal sheets by laser etching, or by stamping out the fixing portions of the metal sheets.

In the scheme, the first injection molding may have a cycle of 10 seconds, and the second injection molding may have a cycle of 15 seconds.

The disclosure also provides a USB head, in which four metal sheets are arranged with a certain spacing, wherein the metal sheets are closed at both ends.

The USB head and the making method provided by the disclosure have the following advantages and features:

1. The USB head adopts the metal sheets with both ends being closed so as to conveniently fix the metal sheets; the metal sheets are not deviated or deformed by the high-speed flowing plastics in the injection procedure; the opened metal sheet in the prior art is easy to deviate or deform.

2. The disclosure adopts the split design in the manufacturing technique, which is especially as follows: separately injecting the portion of the metal sheets near to the fixing portion at top and the other portion, and adopting twice injection moulding technique. In comparison with the present once injection moulding technique, the technique greatly simplifies the manufacturing difficulty, improves production efficiency and stability, and reduces manufacturing costs greatly.

3. In the disclosure, the first injection is only to inject the portion near to the fixing portion at the top of the metal sheets; the mould is not complex in structure while there is no structure of slide block and slope top and so on in the first injection; the second injection portion fails to affect the portion of the metal sheets even if the mould is complex in structure. The technical art adopts the once injection moulding technique so that the injected metal sheets are deformed, extruded or degummed.

4. Based on the manufacturing technique of the disclosure, the metal sheets of the first injection is taken as the standard component for specialized production; and then, the produced standard component is directly used. However, each manufacturer produces the products in the first time by the long-time technique adjustment and running-in in the technical art so as to easily cause the problems of projection progress delay and product quality; the yield efficiency is extremely low and the price is increased. The making technique of the disclosure ensures the stability of the product quality to avoid mould re-opening and repeated repairing and adjustment; therefore, the production cost is reduced and the production efficiency is improved.

DETAILED DESCRIPTION

The basic concept of the disclosure is as follows: locating metal sheets with both ends being closed into a first mould and performing a first injection molding; combining the metal sheets with plastics during the first injection molding, and removing a sprue portion and a fixing portion at top of the metal sheets; locating a product subjected to the first injection molding into a second mould and performing a second injection molding; after the second injection molding, removing an exposed fixing portion of the metal sheets from a product subjected to the second injection molding.

The description of the disclosure is further described in detail with reference to the drawings and specific embodiments.

Figure 1:
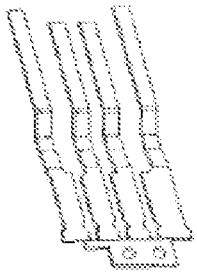
FIG. 1 is a structure diagram of a half-closed USB head.
Figure 2A:
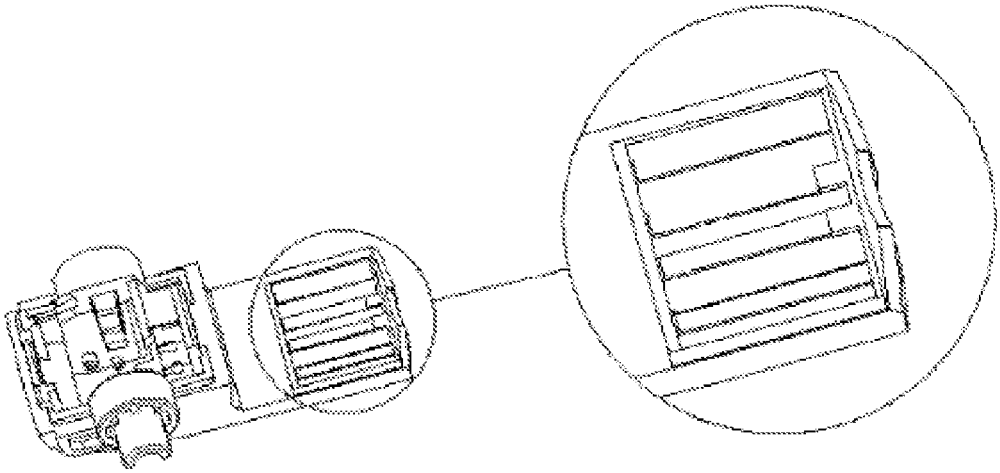
FIG. 2*a* and FIG. 2*b* are structure diagrams of a half-closed USB head and metal sheets with both ends being closed, respectively.
Figure 2B:
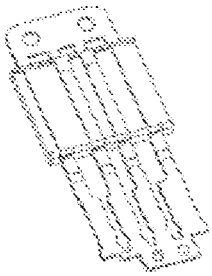

FIG. 2*a* is a structure diagram of a half-closed USB head, which adopts the half-closed structure design of the metal sheets with both ends being closed; the part in the right circle of FIG. 2*a* is an enlarged view of the part in the left circle. The structure is specifically as follows: as shown in FIG. 2*a*, four metal sheets with both ends being closed are arranged with in a certain spacing of the USB head, namely 4 PINs; in comparison with the metal sheets with one end being closed in the prior art, the metal sheets with both ends being closed are well fixed; the metal sheets are not deviated or deformed in the high-speed flowing plastics in the injection procedure. FIG. 2*b* is a structure diagram of metal sheets with both ends being closed in the USB head in FIG. 2*a*. The USB head is applied to terminal products, thus the terminal products are obviously reduced in the volume, and clean and beautiful in appearance. Generally, the USB head is mainly applied to Internet card terminal and also other terminal products.

Figure 3:
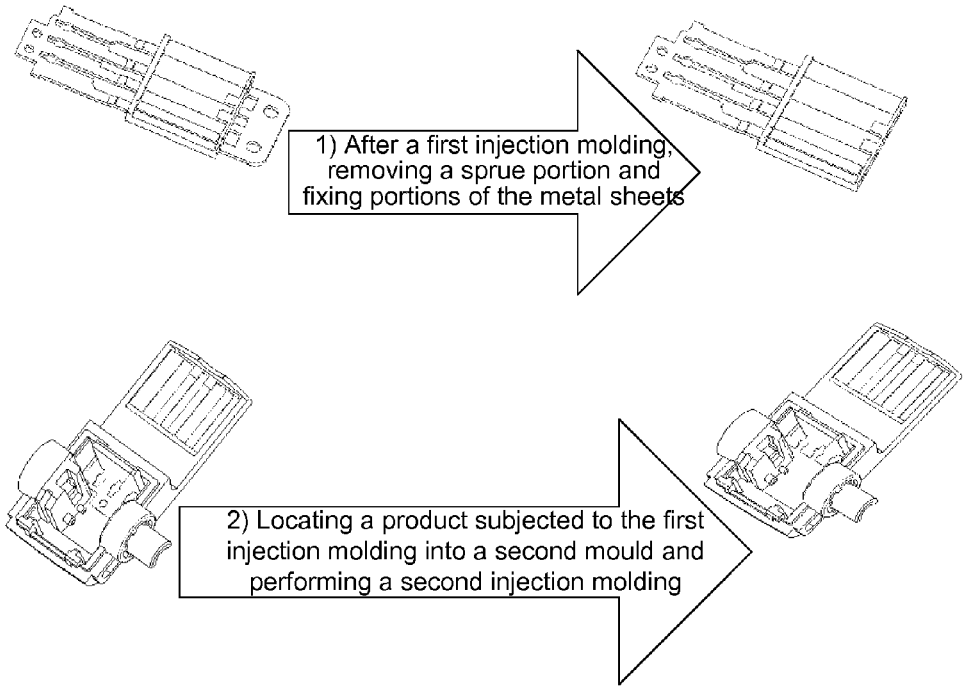
FIG. 3 is a diagram of a procedure for manufacturing a USB head.

FIG. 3 is a diagram of a procedure for manufacturing a USB head, as shown in FIG. 3, the disclosure comprises the metal sheets with both ends being closed; a front small cube of the metal sheets can be only injected in the first injection molding; a front end of the small cube is broken off after the first injection molding, that is, removing or washing off fixing portions at the top of the metal sheets by laser etching or stamping, as shown in step 1); then removing the sprue portion from the product subjected to the first injection molding to locate it into the second mould, and performing the second injection molding; that is, injecting the other portion of the metal sheets except the first injection portion, as shown in step 2); reference sign 31 of the step 2) in FIG. 3 represents the exposed fixing portion of the metal sheets to be removed. In the procedure, fixing the opened metal sheets removed the fixing part in the step 1) by plastics during the first injection molding, so as to avoid PIN corner deviation and pressing. The disclosure comprises the metal sheets with both ends being closed, which will be located into the mould to stably mould and have high efficiency. The disclosure adopts the split manufacturing and second injection technique. Although two moulds and two injection machines are needed, the yield is highly 95% to reduce the technique cost by 0.28 RMB respectively. The traditional technique yield only reaches to 55% and the technique cost is about 0.6 RMB respectively; obviously, the technique cost is saved by 0.32 RMB respectively.

Figure 4:
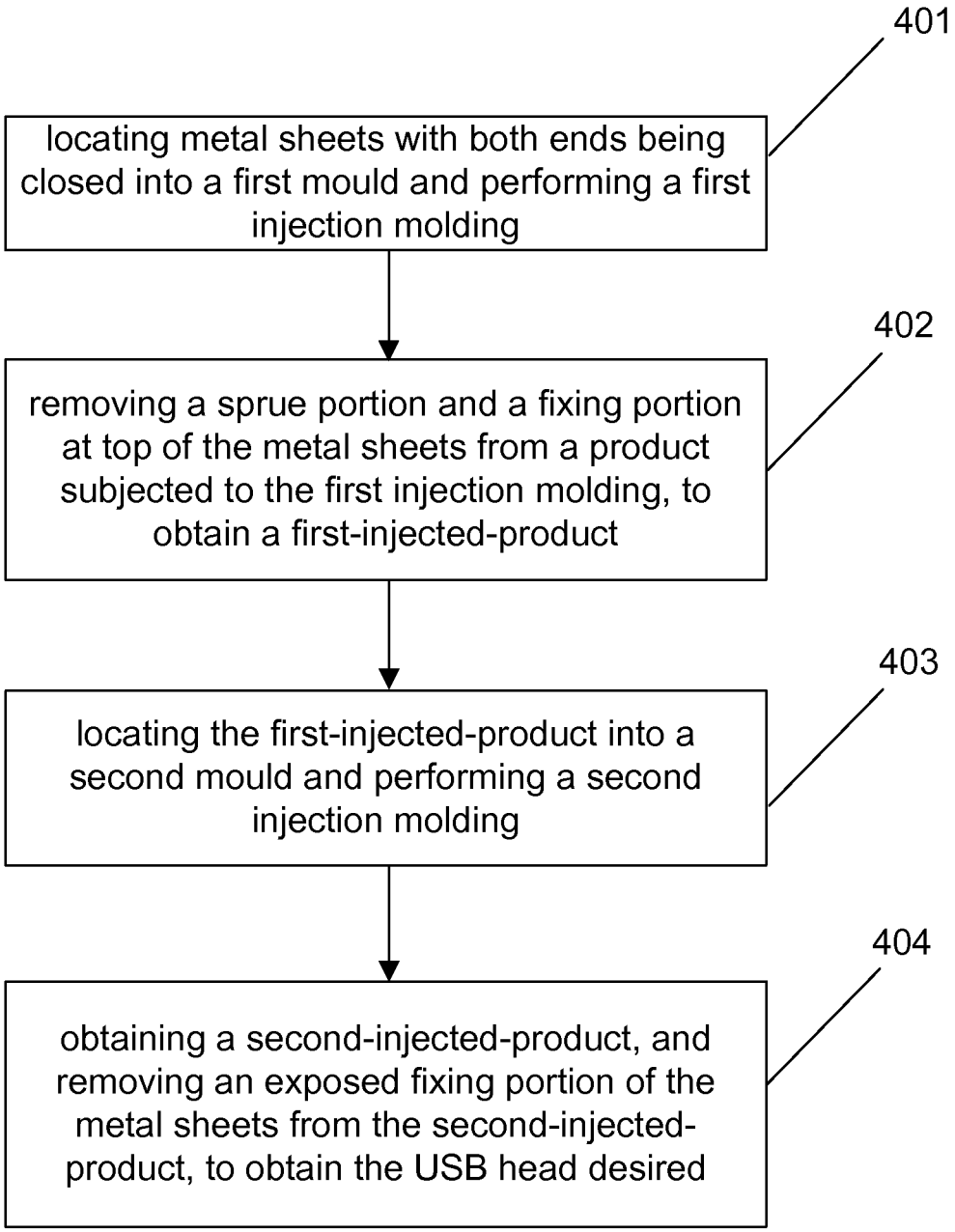
FIG. 4 is a flowchart of a method for manufacturing a USB head.

FIG. 4 is a flowchart of a method for manufacturing a USB head, as shown in FIG. 4, the manufacturing method comprises the following steps.

Step 401: locating metal sheets with both ends being closed into a first mould and performing a first injection molding;

pre-obtaining the existing metal sheets with both ends being closed; adopting the metal sheets with both ends being closed for fixing the metal sheets; closing the two ends of the metal sheets, to avoid being deviated or deformed by high-speed flowing plastics during the injection molding.

Step 402: removing a sprue portion and a fixing portion at top of the metal sheets is from a product subjected to the first injection molding, to obtain a first-injected-product;

wherein removing the fixing portions at the top of the metal sheets by laser etching, or by stamping out the fixing closed ends of the metal sheets.

Step 403: locating the first-injected-product into a second mould and performing a second injection molding;

Step 404: obtaining a second-injected-product, and removing an exposed fixing portion of the metal sheets from the second-injected-product, to obtain the USB head desired;

wherein removing the exposed fixing portions of the metal sheets by laser etching, or by stamping out the fixing portions of the metal sheets.

In the procedure, the first injection molding has a cycle of 10 S, and the second injection molding has a cycle of 15 S.

The metal sheets in the disclosure are specifically elastic metal sheets.

The above is only preferred embodiments of the disclosure, and is not to limit the disclosure. Various modifications and changes can be made to the disclosure without departing from the spirit and principle of the disclosure, any modifications, equivalent substitutes, improvements and the like should be included within the protection scope of the disclosure.

What is claimed is:

1. A method for manufacturing a Universal Serial Bus (USB) head, comprising:

step A: locating metal sheets with both ends being closed into a first mould and performing a first injection molding;

step B: removing a sprue portion and a fixing portion at top of the metal sheets from a product subjected to the first injection molding, to obtain a first-injected-product;

step C: locating the first-injected-product into a second mould and performing a second injection molding; and step D: removing an exposed fixing portion of the metal sheets from a second-injected-product, to obtain the USB head desired.

2. The method according to claim 1, wherein during the first injection molding, only portions near to the fixing portions at the top of the metal sheets are injected.

3. The method according to claim 1, wherein in the steps B and D, the removing the fixing portions of the metal sheets comprises: removing the fixing portions of the metal sheets by laser etching, or by stamping out the fixing portions of the metal sheets.

4. The method according to claim 1, wherein the first injection molding has a cycle of 10 seconds, and the second injection molding has a cycle of 15 seconds.

5. The method according to claim 1, wherein the metal sheets are elastic metal sheets.

6. The method according to claim 2, wherein the first injection molding has a cycle of 10 seconds, and the second injection molding has a cycle of 15 seconds.

7. The method according to claim 2, wherein the metal sheets are elastic metal sheets.

8. The method according to claim 3, wherein the metal sheets are elastic metal sheets.

* * * * *